US008840442B2

(12) United States Patent
Linkon

(10) Patent No.: US 8,840,442 B2
(45) Date of Patent: Sep. 23, 2014

(54) BRASSIERE

(76) Inventor: Nicole Linkon, Newport Coast, CA (US)

( * ) Notice: Subject to any disclaimer, the term of this patent is extended or adjusted under 35 U.S.C. 154(b) by 937 days.

(21) Appl. No.: 11/626,796

(22) Filed: Jan. 24, 2007

(65) Prior Publication Data

US 2008/0176485 A1 Jul. 24, 2008

(51) Int. Cl.
*A41C 3/00* (2006.01)
*A41C 3/14* (2006.01)
*A41C 3/10* (2006.01)

(52) U.S. Cl.
CPC .. *A41C 3/144* (2013.01); *A41C 3/10* (2013.01)
USPC ..... 450/54; 450/57; 450/36

(58) Field of Classification Search
USPC ..... 450/36–38, 54–58
See application file for complete search history.

(56) References Cited

U.S. PATENT DOCUMENTS 3,221,748 A * 12/1965 Glasser ..... 450/56
4,557,267 A * 12/1985 Cole ..... 450/40
4,674,510 A * 6/1987 Sneider ..... 450/57
4,699,144 A * 10/1987 Sherwood ..... 450/54
5,098,330 A * 3/1992 Greenberg ..... 450/55
5,782,672 A 7/1998 Woodley
6,174,217 B1 * 1/2001 Judson ..... 450/1

* cited by examiner

*Primary Examiner* — Gloria Hale
(74) *Attorney, Agent, or Firm* — Rutan & Tucker LLP; Hani Z. Sayed

(57) ABSTRACT

An apparatus to be used as a woman's undergarment is provided. The apparatus is a bra having a strap that fastens to the cups of the bra that protect and hold the breast of the user. The apparatus has a cup having at least a first layer which contacts the individual's skin. The apparatus further has a second layer which is directly opposed to the first layer and may contact the outer clothing of the individual. Moreover, the device has a third layer and/or insert which is positioned between the first layer and the second layer, and further wherein the third layer may provide an extra zone of thickness for the breast nipple and thereby may enable concealment of an erect breast nipple. The third layer may be of varying thickness and in an embodiment that may be thicker than the first and second layer and may be removable from the undergarment if desired.

20 Claims, 4 Drawing Sheets

FIG. 2
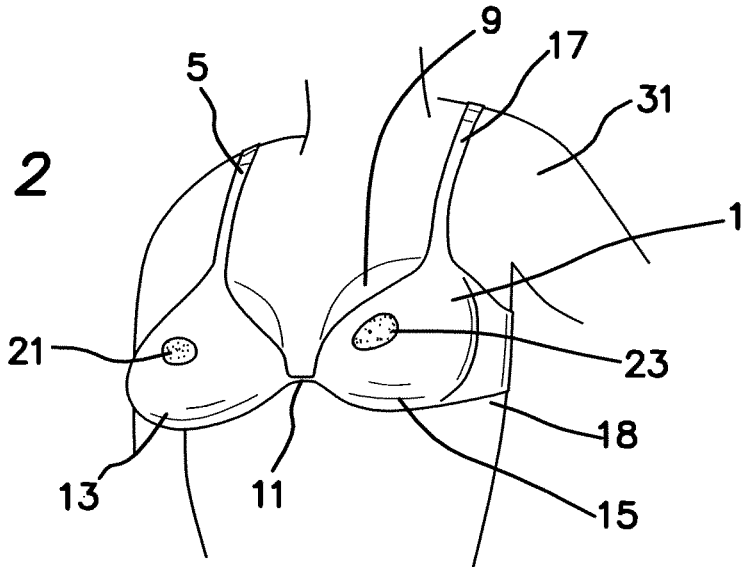
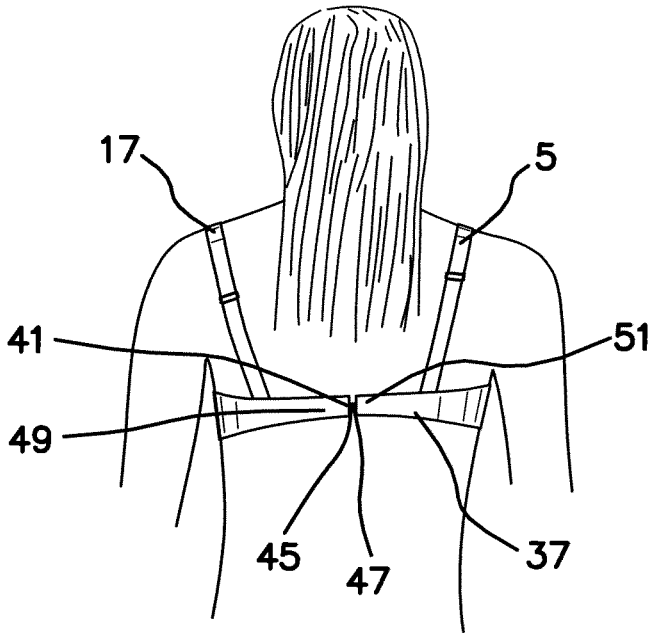
FIG. 3

BRASSIERE

FIELD OF THE INVENTION

The invention relates generally to the field of women's undergarments. More specifically, the present invention relates to an apparatus for women with surgically altered breasts for support and cosmetic purposes.

BACKGROUND OF THE INVENTION

The brassiere has been around for centuries in different forms. The brassiere is commonly referred to as a bra. A bra is a piece of clothing that typically supports, covers and may elevate the breasts of the individual wearing the piece of clothing. It is typically a piece of women's undergarments that are warn with other clothing. The bra is considered a fashion statement and a support structure for women to enhance, support and/or alter the profile of the body.

The bra was originally developed about two centuries ago and has evolved from a corset to the bra that we see today. Bras are different than their earlier garments in that they contain cups to support and cover the breast and also typically have shoulder straps to elevate and lift the breast to a desire height. Additionally, bras may have a variety of different colors, designs, fabrics and cup sizes to fit individuals with larger and/or smaller breast sizes.

The evolution of the bra is typically tied to the socioeconomic status of women throughout history. As women achieved higher and higher status in society, both in new occupations and activities, the outwear and the underwear evolved with these new social status and activities. At various points, women have used these garments and devices to cover, restrain or elevate their breasts.

Early in the development of the modern bra, the most common type of undergarment for the breast was the corset, which was used predominately by wealthier women and women of status. The corset pushed the breast upwards which gave the impression of larger, fuller breasts and helped support larger breasts. Later, many clothing designers that worked on women's clothes experimented with corset design by splitting the corset into multiple parts including support structures where the corset included shoulder straps or neck straps.

Soon thereafter, the modern bra became a reality, although they were not common place for the common woman until almost the first half of the $20^{th}$ century. Since that time, the bra has become a very common garment used my most post-puberty women. The bra serves multiple purposes including both functionality of support, lift and body sculpturing. Additionally, the bra also serves a design purpose including visual enhancement and sometimes as a stand alone design characteristic.

The common bra typically consists of cups for the breasts, a center panel, a band running around the torso under the breast, and a shoulder strap for each side. Bras typically are made of some fabric, usually cotton or polyester. However, they can be constructed from spandex, lace and a plurality of different materials depending on the taste and feel of the individual. The cups of the bra are usually reinforced by underwire made of metal and/or plastic. Additionally, the bra is usually fastened with a hook fastener on the band, typically at the back. However, sometimes the fastener may be located on the front portion or even side portion of the bra depending on style, taste and design.

Many bras are fashioned with significant padding that functions to increase comfort and to make the breasts look bigger. Other types of bras, such as the push up bras, are designed to enhance the cleavage, and use padding to achieve this effect.

However, in the early 1960's a new problem came into play with the advent of breast augmentation. With breast augmentation, round or shaped breast implants are inserted either on top of or below the pectoral muscle, which is the large chest muscle the breast lies on top of. The implants can be inserted through the armpits, via the nipples, from below the breast, or even from the umbilicus through very small incisions, which leave minimal scarring of the breast tissue. An advantage of the procedure of having breast augmentation is the breasts ability to be supported by the implant. Women having received breast augmentations typically do not need as much support and/or lift that a bra provides and therefore many women with breast augmentation do not wear bras.

However, many individuals with breast augmentations may want to wear a bra for support, design and style. But these individuals do not need the formal structure of the bra including the straps, underwire and other support means because typically the after effects of breast augmentation allows for a woman to function without the need for a bra. Another potential problem for women that have undergone breast augmentation is the sensitivity of the breast nipples. Changes in sensitivity of the breast nipple may occur after breast augmentation whereby some individuals suffer from a lost of sensitivity. However, a large amount of women suffer from the opposite problem. Many women, after breast augmentation, are prone to breast nipple sensitivity wherein the breast nipple remains in a prolonged erect state. While a women with breast augmentation may not need a bra to support or lift her breasts, she may prefer to wear a bra to conceal the erect nipple from showing through the clothing.

Accordingly, a need therefore still exists for an apparatus that may be utilized by women with breast augmentation that is aesthetically pleasing yet functional.

Moreover, a need therefore exists for an improved bra design for women with breast augmentations wherein the bra provides very little support for the surgically enhanced breast, but allows for concealment of erect nipples in an aesthetically pleasing design.

SUMMARY OF THE INVENTION

The present invention relates to an apparatus that may be used as a woman's undergarment. Additionally, the present invention may be utilized in other women's garments including dresses and swim wear. The apparatus may be a bra having a strap that fastens to each of the cups of the bra to protect and hold the breast of the user. The apparatus has a cup having a first layer which contacts the individual's skin. The apparatus further has a second layer which is directly opposed to the first layer and may contact the outer clothing of the individual. Moreover, the device has a third layer and/or insert which is positioned between the first layer and the second layer and further wherein the third layer may provide an extra zone of thickness for the breast nipple and thereby enable concealment of an erect breast nipple.

In an exemplary embodiment the present invention, a women's undergarment is provided. The undergarment has a first and second shoulder strap having a front end and a back end adapted to extend over the shoulder of an individual. Additionally, the undergarment has a back strap whereby the first and second shoulder strap extend over the shoulder and are connected to the back strap by a fastening means. Moreover, the undergarment has a first cup and second cup attached to the first and second shoulder straps, the first and second cup adapted to support the breast and at least one insert whereby the insert is positioned directly in front of the nipple of an individual to conceal the nipple from showing through clothing.

In an exemplary embodiment, the undergarment has a first cup and second cup that are comprised of a plurality of layers.

In an exemplary embodiment, the undergarment has a first cup and second cup having a first layer and a second layer whereby the first layer and second layer are separated from each other and further wherein the first layer is adapted to be in contact with the breast of the individual and the second layer is adapted to be in proximity to the outer garment of the individual.

In an exemplary embodiment, the undergarment has a first cup and second cup that has a first layer and a second layer wherein the insert fits between the first layer and the second layer.

In an exemplary embodiment, the undergarment has a first cup and second cup that has a first layer and second layer wherein the insert is affixed to the first layer.

In an exemplary embodiment, the undergarment has a first cup and second cup that has a first layer and a second layer wherein the insert is placed between the first and second layer and further wherein the insert is proportioned smaller than the total space utilized by the first and second layers and wherein the insert is removably affixed to either of the first and second layers by an attachment means.

In an exemplary embodiment, the undergarment has an insert that is of greater thickness than either of the first and second layers of the undergarment.

In an exemplary embodiment, the undergarment has a first cup and second cup having a first layer and second layer wherein the first and second layer are constructed of a similar material.

In an exemplary embodiment, the undergarment has a first cup and the second cup having a first layer and a second layer wherein the first and second layers are constructed of different materials.

In an exemplary embodiment, the undergarment has an insert dimensioned for coverage of the nipple of the individual wherein the insert is thickest at a position where the nipple contacts the insert.

In an exemplary embodiment, the undergarment has a first and second cup having a first layer and a second layer which are removably attached from one another by a fastener means whereby the fastener means allows for an opening between the first layer and the second layer.

In an exemplary embodiment, the undergarment has a fastener means which is a hook and loop system.

In an exemplary embodiment, the undergarment has an insert which is constructed into a cosmetic and aesthetic design and placed within the first cup and second cup of the undergarment.

To this end, in an exemplary embodiment of the present invention, a method for using a women's undergarment is provided. The method comprises the steps of: providing a first and second shoulder strap having a front end and a back end adapted to extend over the shoulder of an individual; providing a back strap whereby the first and second shoulder strap extend over the shoulder and are connected to the back strap by a fastening means; providing a first cup and second cup attached to the first and second shoulder straps, the first and second cup adapted to support the breast; and inserting an insert into the first and second cup whereby the insert is positioned directly in front of the nipple of an individual to conceal the nipple from showing through clothing.

In an exemplary embodiment, the method comprises the step of: positioning the insert between a first layer and a second layer of the first cup and the second cup of the undergarment.

In an exemplary embodiment, the method comprises the step of: removably affixing the insert to the first and second cup of the undergarment utilizing an attachment means whereby the attachment means is a hook and loop system.

In an exemplary embodiment, the method comprises the step of: providing a first cup and second cup having a first layer and a second layer wherein the insert is placed between the first layer and second layer at a position corresponding to the nipple of the breast of the individual.

In an exemplary embodiment, the method comprises the step of: providing a first cup and second cup having a first layer and second layer wherein the insert is placed between the first layer and the second layer and whereby the insert has a thickness greater than the first layer and second layer.

In an exemplary embodiment, the method comprises the step of: allowing an individual to separate a first layer and a second layer of a first and second cup whereby the individual may introduce, adjust or remove the insert from between the first layer and second layer of the first cup and second cup of the undergarment.

In an exemplary embodiment, the method comprises the step of: allowing an individual to separate a first layer and a second layer of a first and second cup by the use of a fastener means whereby the fastener means may allow for manual manipulation of the first and second layers whereby the individual may insert, adjust or remove the insert from between the first layer and second layer of the first cup and second cup of the undergarment.

To this end, in an exemplary embodiment of the present invention, a convenient apparatus relating to a women's undergarment is provided.

In another exemplary embodiment, a women's undergarment is provided. The undergarment may be constructed for women who do not need as much structured support for the breasts.

Another exemplary embodiment is a women's undergarment that may have a plurality of layers therein wherein the plurality of layers may increase the comfort of the undergarment.

Yet another exemplary embodiment of the present invention is to provide a women's undergarment wherein the undergarment may be constructed for individuals that do not need the extra support of a conventional prior art bra.

Still another exemplary embodiment of the present invention is to provide a women's undergarment wherein the undergarment may be constructed for individuals having surgically enhanced breasts.

An exemplary embodiment of the present invention is to provide a women's undergarment wherein the undergarment may be constructed for individuals having just reached puberty wherein the individual does not need extra support to lift and support the breast.

Yet another exemplary embodiment of the present invention is to provide a women's undergarment wherein the undergarment may be constructed for individuals having surgically augmented breasts.

Another exemplary embodiment of the present invention is to provide a women's undergarment wherein the undergarment may be constructed for individuals having surgically lifted breasts and/or breasts that are not prone to normal gravitational pulls.

Still another exemplary embodiment of the present invention is to provide a women's undergarment wherein the undergarment may be constructed with a shoulder strap for comfort.

An exemplary embodiment of the present invention is to provide a women's undergarment wherein the undergarment may have a cup to hold and/or support the breast of the individual utilizing the undergarment.

Yet another exemplary embodiment of the present invention is to provide a women's undergarment wherein the undergarment may have a support structure such as an underwire if desired, but would preferably not have said support structure.

Still another exemplary embodiment of the present invention is to provide a women's undergarment wherein the undergarment may have a plurality of layers, including a first layer, a second layer and a third layer.

Another exemplary embodiment of the present invention is to provide a women's undergarment wherein the undergarment may have a plurality of layers wherein the plurality may include at least 2 layers.

An exemplary embodiment of the present invention is to provide a women's undergarment wherein the undergarment may have a plurality of layers wherein the plurality of layers may be constructed of different materials.

Still another exemplary embodiment of the present invention is to provide a women's undergarment wherein the undergarment may have a plurality of layers wherein the plurality of layers may be constructed of the same materials.

Yet another exemplary embodiment of the present invention is to provide a women's undergarment wherein the undergarment may be constructed with a plurality of layers wherein some of the layers may have similar materials, while other layers have different materials.

Still another exemplary embodiment of the present invention is to provide a women's undergarment wherein the undergarment may be constructed with a plurality of layers wherein some of the layers may have similar materials, while other layers have different materials wherein the differing materials may have different functions such as support, comfort and/or concealment.

Another exemplary embodiment of the present invention is to provide a women's undergarment wherein the undergarment may have a plurality of layers where at least one layer may be thicker at its midpoint.

Yet another exemplary embodiment of the present invention is to provide a women's undergarment wherein the undergarment may have a plurality of layers where at least one layer may be thicker than other layers and further wherein the thicker layer may be thicker only a certain specified points such as the point that contacts the nipple of the breast of an individual.

Another exemplary embodiment of the present invention is to provide a women's undergarment wherein the undergarment may have a plurality of layers including a first layer, a second layer and a third layer wherein the first layer and third layer may be of a uniform thickness and wherein the second layer may be of a thickness greater than both the first and third layers.

Yet another exemplary embodiment of the present invention is to provide a women's garment for concealment of the erect nipple of an individual wherein the present invention may be utilized in a dress and additionally may be utilized in women's swim wear.

Additionally, in an exemplary embodiment, the device may be utilized in women's dresses, tank tops, blouses and/or any other garment that may conceal the erect nipple of the individual.

Still another exemplary embodiment of the present invention is to provide a women's undergarment wherein the undergarment may be constructed with a plurality of colors.

Yet another exemplary embodiment of the present invention is to provide a women's undergarment wherein the undergarment may have a plurality of layers including a first layer, a second layer and a third layer wherein the first layer and third layer may completely surround and enclose the second layer.

In yet another exemplary embodiment of the present invention is to provide a women's undergarment wherein the undergarment may have a plurality of layers wherein the at least one layer may be thicker than the other of the plurality of layers.

Another exemplary embodiment of the present invention is to provide a women's undergarment wherein the undergarment may have a plurality of layers wherein one layer may not take up the entire volume of the other of the plurality of layers.

Still another exemplary embodiment of the present invention is to provide a women's undergarment wherein the undergarment may have a plurality of layers wherein a first layer and second layer may be adjacent, and a third layer may be in contact with the breast of the individual and wherein the third layer is of differing thickness to the first and second layer.

Yet another exemplary embodiment of the present invention is to provide a women's undergarment wherein the undergarment may be machine and/or hand washable.

Another exemplary embodiment of the present invention is to provide a women's undergarment wherein the undergarment may have a plurality of layers wherein a first layer and second layer may be adjacent, and a third layer may be in contact with the breast of the individual and wherein the third layer is of differing material than the first and second layers.

Still another exemplary embodiment of the present invention is to provide a women's undergarment wherein the undergarment may have a plurality of layers wherein at least one layer may be removed from the undergarment if desired.

Another exemplary embodiment of the present invention is to provide a women's undergarment wherein the undergarment may have a plurality of layers wherein at least one layer may be removed from the undergarment and replaced with another layer having either an increased or decreased thickness.

Yet another exemplary embodiment of the present invention is to provide a women's undergarment wherein the undergarment may be constructed of cotton.

Still a further exemplary embodiment of the present invention is to provide a women's undergarment wherein the undergarment may be constructed of polyester.

Another exemplary embodiment of the present invention is to provide a women's undergarment wherein the undergarment may be constructed of lace.

In another exemplary embodiment of the present invention is to provide a women's undergarment wherein the undergarment may be constructed of nylon.

Still another exemplary embodiment of the present invention is to provide a women's undergarment wherein the undergarment may be constructed of any suitable material.

Yet another exemplary embodiment of the present invention is to provide a women's undergarment wherein the undergarment may have a plurality of layers wherein the layers may be constructed of different materials including cotton, polyester, lace, nylon and/or any other suitable material.

Still another exemplary embodiment of the present invention is to provide a women's undergarment wherein the undergarment may have a plurality of layers wherein at least one layer provides the advantage of concealing the erect nipple of the breast of the individual wearing the undergarment.

Yet another exemplary embodiment of the present invention is to provide a women's undergarment wherein the undergarment allows for concealment of the erect nipple of the breast of the wearer.

Various objects, features, aspects and advantages of the present invention will become more apparent from the following detailed description of preferred embodiments of the invention, along with the accompanying drawings in which like numerals represent like components.

Additional features and advantages of the present invention are described herein, and will be apparent from the detailed description of the presently preferred embodiments and from the drawings.

BRIEF DESCRIPTION OF THE DRAWING

FIG. 2 is another front perspective view of the brassiere in an exemplary embodiment of the present invention;

FIG. 3 is a back view of the brassiere in an exemplary embodiment of the present invention;

DETAILED DESCRIPTION

Figure 1:
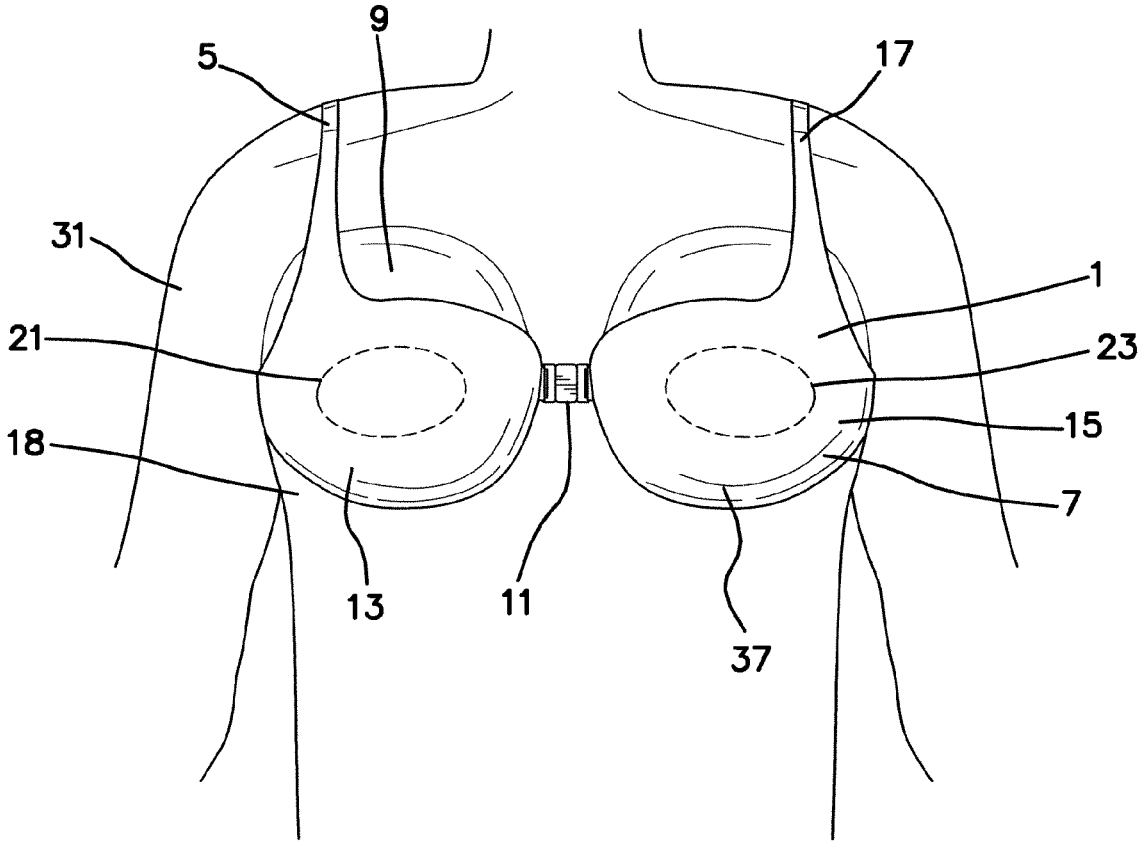
FIG. 1 is a front perspective view of the new brassiere in an exemplary embodiment of the present invention.

Turning now to the drawings wherein elements are identified by numbers and like elements are identified by like numbers throughout the 7 figures, the invention is depicted in FIG. 1 and illustrates a brassiere 1 that may be utilized by an individual 31 that may not need the help of the support underwire (not shown).

Referring first to FIG. 1, a brassiere 1 is provided. The brassiere (hereinafter referred to as a bra) may have a plurality of different configurations, but for illustrative purposes is shown in conventional common use form. Thereby, the bra 1 may have a shoulder strap 5 and a cup 7 that may be used to hold and/or support the breast 9 of an individual 31. The bra may have a clasp 11 between a first cup 13 and a second cup 15 of the bra 1. The bra 1 may have a contoured shape in an exemplary embodiment whereby the bra cups 13, 15 are shaped to hold and/or support the breast 9 of the individual. In an exemplary embodiment, the bra 1 is produced for those individuals who do not require the structural element of an underwire (not shown) and/or push up facilities.

Referring first to FIG. 1, a brassiere 1 is provided. The brassiere (hereinafter referred to as a bra) may have a plurality of different configurations, but for illustrative purposes is shown in conventional common use form. Thereby, the bra 1 may have a shoulder strap 5 and a cup 13 that may be used to hold and/or support the breast 9 of an individual 31. The bra may have a clasp 11 between a first cup 13 and a second cup 15 of the bra 1. The bra 1 may have a contoured shape in an exemplary embodiment whereby the bra cups 13, 15 are shaped to hold and/or support the breast 9 of the individual. In an exemplary embodiment, the bra 1 is produced for those individuals who do not require the structural element of an underwire (not shown) and/or push up facilities.

FIG. 1 further illustrates a first cup 13 and the second bra cup 15 wherein each of the respective cups 13 and 15 may have a first insert 21 and a second insert 23. The first insert 21 and the second insert 23 may be placed within the first bra cup 13 and the second bra cup 15 respectively. The inserts 21, 23 are configured to be of a thickness greater than the thickness at any other point in the bra 1. Further the inserts 21 and 23 are configured to be positioned at the contact point of the nipple of the breast and would thereby conceal the erect nipple of the individual utilizing the bra 1. The inserts 21 and 23 may be either permanently affixed to the bra and/or in an exemplary embodiment, may be insertable and/or removed from the bra 1 if desired. Additionally, the ability to insert and/or remove the inserts 21, 23 may also give the user the ability to manipulate and move the inserts 21, 23 into the desire position within the bra 1. For example, many women have nipples that may not be at the mid point of the breast. This is sometimes the result of augmented breasts and/or other breast surgeries. Often times, the nipple is not centralized on the breast tissue. The present invention may allow for manipulation of the inserts 21, 23 into a position that results in correct alignment of the inserts 21, 23 about the nipple of the individual.

As illustrated in FIGS. 2 and 3, the bra 1 may have the shoulder straps 5, 17 attached to the first and second cups 13, 15 of the bra 1. Also illustrated therein within the cups 13, 15 are the removable inserts 21, 23 whereby the inserts 21, 23 may be at different positions within the bra 1 as needed to conceal the erect nipple of the user 31. In an exemplary embodiment, the inserts 21, 23 may have an adhesive 35 to attach to the outside layer 37 of the bra 1 (shown in FIG. 4). In another exemplary embodiment, the inserts 21, 23 may utilize a hook and fastener means 39 to attach to the outside layer 37 of the bra 1 whereby the user 31 may detach the inserts 21, 23 from the bra 1 completely when desired, or in the alternative, may utilize the fastening means 39 to alter the position of the inserts 21, 23 to properly conceal the erect nipple of the user 31. In another exemplary embodiment, a shelf or pocket (not shown) may be utilized to allow for positioning of the inserts 21, 23 in the cup 13, 15 of the bra 1. The shelf and/or pocket may be constructed into the bra 1 and may allow for proper placement of the inserts 21, 23 and allow for easy removal and placement within the cups 13, 15.

FIG. 3 illustrates the back portion 37 of the bra 1. In an exemplary embodiment, the strap portions 5, 17 may be connected at the back portion 37 by a locking member 41. The locking member 41 may be a latch 45 whereby the latch 45 may be a clasp 47 for attaching the straps to a first back strap 49 and a second back strap 51.

Figure 4:
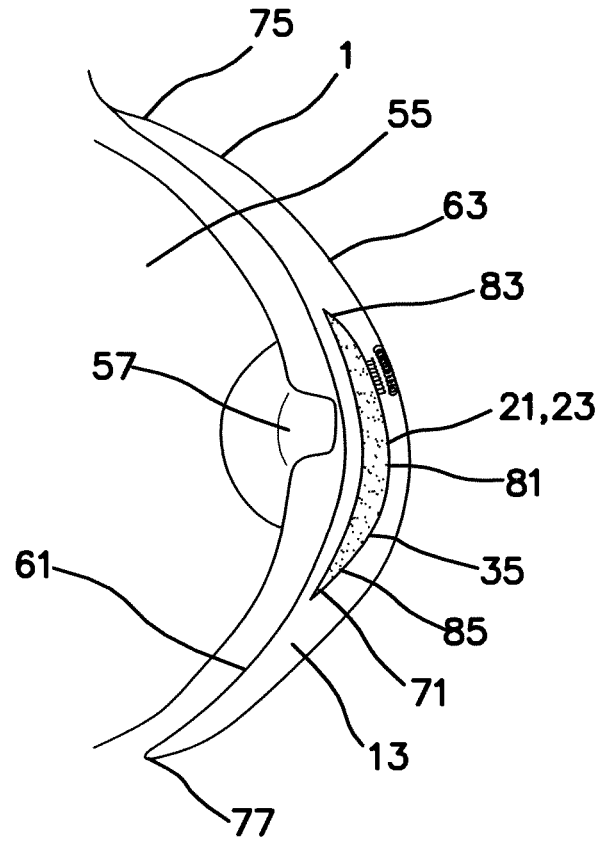
FIG. 4 is a cross sectional side view of the breast of an individual and the brassiere in an exemplary embodiment of the present invention.

FIG. 4 illustrates a cross-sectional view of the bra 1 as utilized by an individual 31. As illustrated, the breast 55 having a nipple 57 is shown wherein the breast 55 may be covered by a cup 13 of the bra 1. In an exemplary embodiment, the bra 1 may have a first layer 61 and a second layer 63. The first layer 61 may contact the breast 55 of the individual and may be constructed of any suitable material such as cotton, polyester, lace, nylon and the like. In an exemplary embodiment, the first layer 61 is constructed of cotton for comfort. The second layer 63 is the outer most layer and may contact the clothes (not shown) of the individual 31. The second layer 63 may be constructed of any suitable material such as cotton, polyester, lace, nylon and the like. In an exemplary embodiment, the second layer 63 may be constructed of cotton for comfort. However, it should be understood that the first layer 61 and the second layer 63 may be constructed of different materials depending on comfort, aesthetic preferences and the like. The first layer 61 and the second layer 63 are preferably of equal thickness and attached to each other at the strap portion 5 of the bra 1.

Figure 6A:
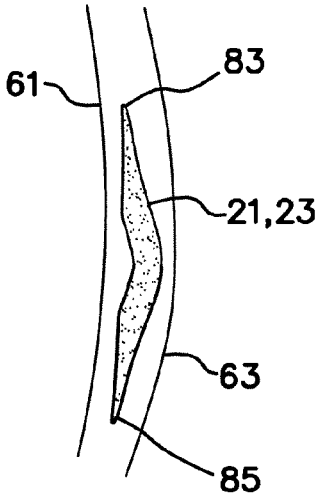
FIG. 6A is a cross-sectional side view of a brassiere in an exemplary embodiment of the present invention.
Figure 6B:
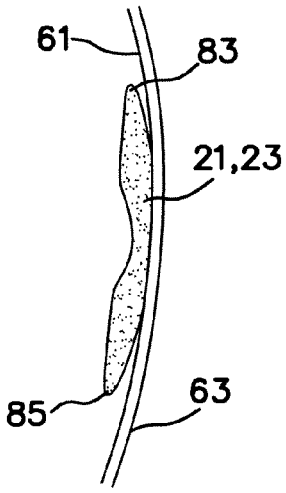
FIG. 6B is another cross-sectional side view of a brassiere in an exemplary embodiment of the present invention.
Figure 6C:
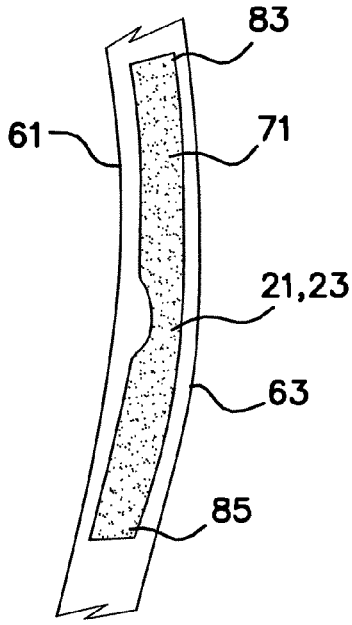
FIG. 6C is another cross-sectional side view of a brassiere in an exemplary embodiment of the present invention.

FIG. 4 further illustrates a third layer 71. The third layer 71 may be the inserts 21, 23 mentioned above. The third layer 71 is of greater thickness than either of the first and second layers 61, 63. Additionally, the third layer 71 may not utilize the entire space from the top portion 75 of the bra cup 12 to the bottom portion 77 of the bra cup 12. Thereby the third layer 71 may only occupy a smaller portion of the space between the first layer 61 and the second layer 63. As illustrated in FIG. 4, the third layer inserts 21, 23 may have a tapered shape wherein the mid-point 81 of the insert 21 is thicker than the top portion 83 and/or bottom portion 85 of the insert 21. The mid-point thickness helps to greatly reduce or completely eliminate the display of an erect nipple through the fabric of the bra 1. Additionally, the localized positioning of the insert 21 within the first and second layers 61, 63 may eliminate unwanted bulk and weight of the bra 1 for the individual 31. FIG. 4 illustrates the insert 21 placed between the first layer 61 and the second layer 63. However, as illustrated in FIGS. 6A, 6B and 6C, the insert may be placed in different positions within the layers 61, 63 and may be of varying sizes depending on the need of the individual 31. It is contemplated that the present invention be utilized by women having breast augmentation and/or surgically enhanced breasts, but may be also utilized by teens or individuals that do not need additional lift and support for their breasts. FIG. 6A illustrates the insert 21 placed between the first layer 61 and the second layer 63. FIG. 6B illustrates the insert 21 being positioned on the inside of the first layer 61 whereby the insert 21 may be attached to the first layer 61 and may directly contact the nipple 57 of the individual. The insert 21 may be fastened to the first layer 61 by a fastener means 39 whereby the individual 31 may shift or move the insert 21 as desired to place the insert 21 over the nipple 57. Additionally, if desired, the individual 31 may completely remove the insert 21 from the bra 1. FIG. 6C illustrates an insert with a much thicker top portion 83 and bottom portion 85 whereby individuals that wish for a more uniform breast look, or for the perception of larger breasts 55 may have the added padding of the insert 21 give that perception.

Figure 7:
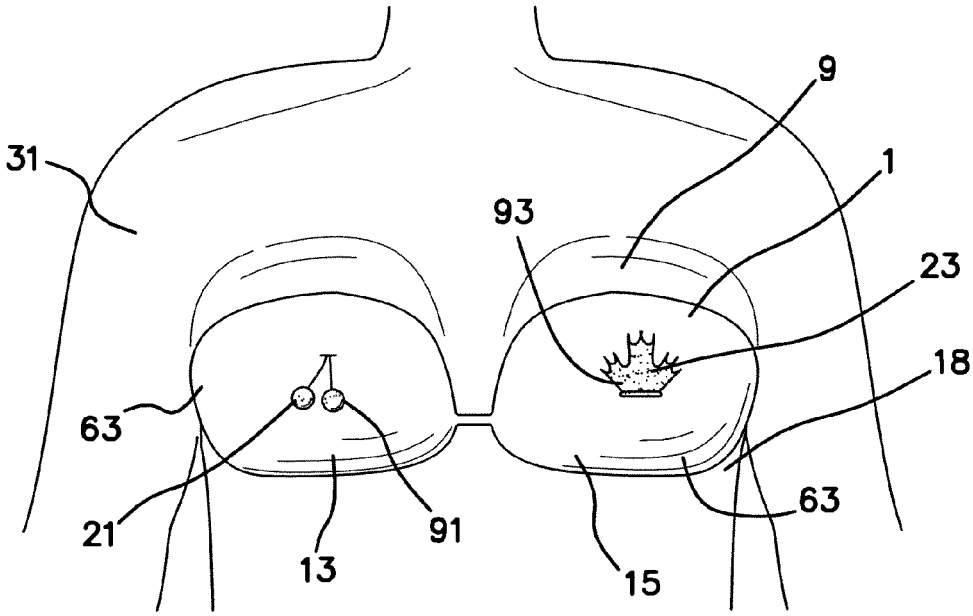
FIG. 7 is a front view of the brassiere in an exemplary embodiment of the present invention.

FIG. 7 illustrates that the inserts 21, 23 may be attached to the second layer 63 of the bra 1 and/or may be seen through the second layer 63 whereby the inserts 21, 23 may depict a variety of different characters, emblems or designs. In the illustrated embodiment, the bra 1 has an insert 21, whereby the insert is designed in the form of a cherry 91 and the second insert 23 is designed in the form of a leaf 93.

Figure 5:
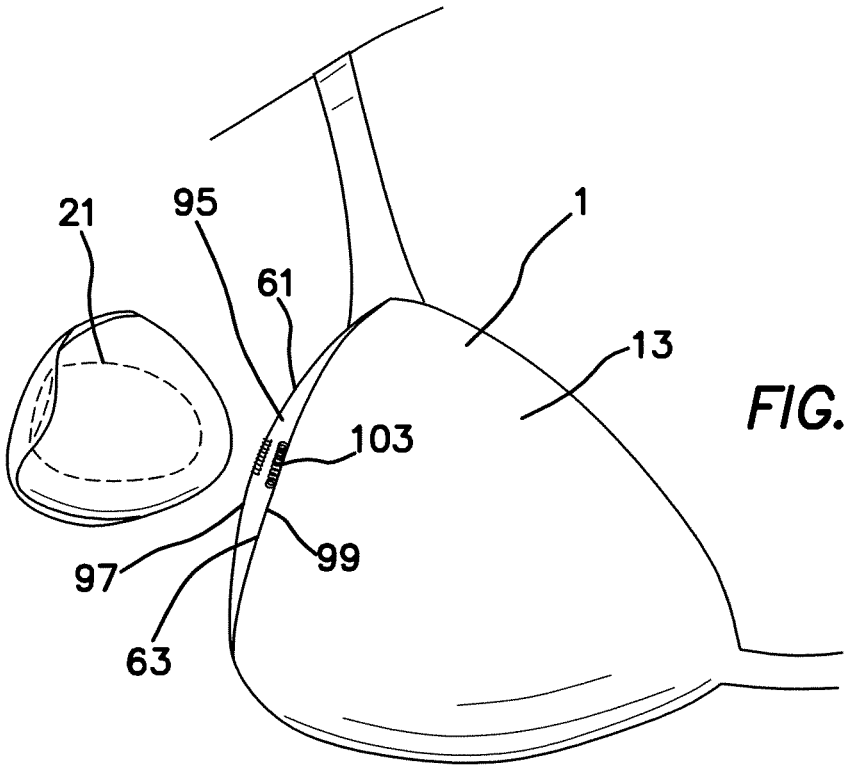
FIG. 5 is a front view of the brassiere in an exemplary embodiment of the present invention.

FIG. 5 illustrates the insert 21 being placed within the first cup 13 of the bra 1. In an exemplary embodiment, the first layer 61 and the second layer 63 may be separated by an opening 95, whereby the opening 95 may be positioned on an outside portion 97 of the first layer 61 and an outside portion 99 of the second layer 63. The first layer 61 and second layer 63 may have an opening 95 whereby the opening 95 allows for insertion of the insert 21 into a position between the first layer 61 and the second layer 63. The opening may have an attachment means 103 whereby the attachment means 103 may allow for separating the first layer 61 from the second layer 63 and insertion and removal of the insert 21 from therebetween. The attachment means 103, in an exemplary embodiment is a hook and faster whereby the first layer 61 and the second layer 63 may be easily separated from each other and reattached with little effort by the individual 31 utilizing the bra 1. In an additional exemplary embodiment, the inserts 21, 23 may be attached to the first and/or second layers 61, 63 by a pocket or shelf system whereby a small pocket or shelf (not shown) is built into either of the first 61 and/or second 63 layers whereby the insert 21, 23 may be inserted into the shelf or pocket thereby removing the need for an attachment means 103. However, it should be understood that the attachment means 103 may be any method or apparatus to attached the first layer 61 to the second layer, such as a snap-on, clasp, zipper, button, shelf system, pocket or the like.

Thus, specific embodiments and applications of a safety device system have been disclosed. It should be apparent, however, to those skilled in the art that many more modifications besides those already described are possible without departing from the inventive concepts herein. The inventive subject matter, therefore, is not to be restricted except in the spirit of the appended claims. The terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A women's undergarment, the undergarment comprising:

a first and second shoulder strap having a front end and a back end adapted to extend over the shoulder of an individual;

a back strap whereby the first and second shoulder strap extend over the shoulder and are connected to the back strap by a fastening means;

a first cup and second cup attached to the first and second shoulder straps, the first and second cup adapted to support the breast wherein the first and second cups have a plurality of layers including at least a first layer and a second layer wherein a space exists between the first layer and the second layer;

at least one insert whereby the insert is sized to conceal the nipple of the individual and further wherein the insert is thicker only at a certain specified point that contacts the nipple of the breast of an individual and further wherein the insert allows the user to manipulate the insert into the desired position that results in the correct alignment of the insert about the nipple of the individual wherein the insert is replaceable with another insert having either an increased or decreased thickness wherein the insert depicts designs, emblems and characters which are perceptible through the second layer;

the insert having a thickness greater than both the first and second layers and further wherein the insert has a tapered shape wherein a mid-point of the insert is thicker than either a top portion or bottom portion of the insert;

an opening between the first layer and the second layer of the first and second cup wherein said insert is inserted into the opening between the first and second layers and is affixed to the first layer;

a shelf whereby the shelf is built into the undergarment and further wherein the insert is placed into the shelf to support its position; and said insert does not take up the entire space that exists between the first and second layers.

2. The undergarment of claim 1, wherein the first cup and second cup are comprised of a plurality of layers.

3. The undergarment of claim 1, wherein the first cup and second cup have a first layer and a second layer whereby the first layer and second layer are separated from each other and further wherein the first layer is adapted to be in contact with the breast of the individual and the second layer is adapted to be in proximity to the outer garment of the individual.

4. The undergarment of claim 1 wherein the first cup and second cup have a first layer and a second layer wherein the insert fits between the first layer and the second layer.

5. The undergarment of claim 1 wherein the first cup and second cup have a first layer and a second layer wherein the insert is placed between the first and second layer and further wherein the insert is proportionally smaller than the total space utilized by the first and second layers and wherein the insert is removably affixed to either of the first and second layers by an attachment means.

6. The undergarment of claim 1 wherein the insert is of greater thickness than either of the first and second layers of the undergarment.

7. The undergarment of claim 1 wherein the first cup and second cup have a first layer and second layer wherein the first and second layer are constructed of a similar material.

8. The undergarment of claim 1 wherein the first cup and the second cup have a first layer and a second layer wherein the first and second layers are constructed of different materials.

9. The undergarment of claim 1 further comprising:

the insert dimensioned for coverage of the nipple of the individual wherein the insert is thickest at a position where the nipple contacts the insert.

10. The undergarment of claim 1 wherein the first and second cups have a first layer and a second layer which are removably attached from one another by a fastener means whereby the fastener means allows for an opening between the first layer and the second layer.

11. The undergarment of claim 10 wherein the fastener means is a hook and loop.

12. The undergarment of claim 1 wherein the insert is constructed with a cosmetic and aesthetic design and placed within the first cup and second cup of the undergarment.

13. A method for using a women's undergarment, said method comprising the steps of:

providing a first and second shoulder strap having a front end and a back end adapted to extend over the shoulder of an individual;

providing a back strap whereby the first and second shoulder strap extend over the shoulder and are connected to the back strap by a fastening means;

providing a first cup and second cup attached to the first and second shoulder straps, the first and second cup adapted to support the breast wherein the first and second cups have a plurality of layers including at least a first layer and a second layer wherein a space exists between the first layer and the second layer;

inserting a removably attachable insert wherein the insert depicts designs, emblems and characters which are perceptible through the second layer wherein the insert is placed between the first and second layers whereby the insert allows the user to manipulate the insert into the desired position that results in the correct alignment of the insert about the nipple of the individual and wherein the insert is sized to conceal only the nipple of the individual user and wherein the insert is further sized to be thicker than the thickness of the first and second layers;

the insert has a tapered shape wherein a mid-point of the insert is thicker either a top portion or bottom portion of the insert;

providing an opening between the first layer and the second layer of the first and second cup wherein said insert is inserted into the opening between the first and second layers and is affixed to the first layer;

a shelf built into the undergarment the insert is placed into the shelf to support its position; and said removably attachable insert is sized to only conceal the nipple of the individual user and does not encompass the entirety of the space between the first and second layers and further wherein the removably attachable insert is replaceable with another insert having either an increased or decreased thickness.

14. The method of claim 13, further comprising the step of:

positioning the insert between a first layer and a second layer of the first cup and the second cup of the undergarment.

15. The method of claim 13, further comprising the step of:

removably affixing the insert to the first and second cup of the undergarment utilizing an attachment means whereby the attachment means is a hook and loop system.

16. The method of claim 13, further comprising the step of:

providing a first cup and second cup having a first layer and a second layer wherein the insert is placed between the first layer and second layer at a position corresponding to the nipple of the breast of the individual.

17. The method of claim 13, further comprising the step of:

providing a first cup and second cup having a first layer and second layer wherein the insert is placed between the first layer and the second layer and whereby the insert has a thickness greater than the first layer and second layer.

18. The method of claim 13, further comprising the step of:

allowing an individual to separate a first layer and a second layer of a first and second cup whereby the individual may insert, adjust or remove the insert from between the first layer and second layer of the first cup and second cup of the undergarment.

19. The method of claim 13, further comprising the step of:

allowing an individual to separate a first layer and a second layer of a first and second cup by the use of a fastening means whereby the fastening means may allow for manual manipulation of the first and second layers whereby the individual may introduce, adjust or remove the insert from between the first layer and second layer of the first cup and second cup of the undergarment.

20. The undergarment of claim 1 wherein the characters, emblems and designs of the insert include names, fruits, symbols and logos.

* * * * *